US005866976A

United States Patent [19]

Iwai et al.

[11] Patent Number: 5,866,976

[45] Date of Patent: Feb. 2, 1999

[54] ELECTRON GUN WITH REDUCED CAPACITANCE BETWEEN ELECTRODES AND CATHODE-RAY TUBE USING THE GUN

[75] Inventors: Yoshikazu Iwai; Masaki Kawasaki; Yasuyuki Shibuta, all of Osaka, Japan

[73] Assignee: Matsushita Electronics Corporation, Osaka, Japan

[21] Appl. No.: 812,753

[22] Filed: Mar. 6, 1997

[30] Foreign Application Priority Data

Mar. 19, 1996 [JP] Japan ..... 8-051276

[51] Int. Cl.[6] ..... H01J 1/26

[52] U.S. Cl. ..... 313/447; 313/456; 315/379

[58] Field of Search ..... 313/447, 446, 313/452, 456; 315/14, 379

[56] References Cited

U.S. PATENT DOCUMENTS 4,855,639 8/1989 Van Eck ..... 313/456
5,221,875 6/1993 Odenthal ..... 313/447

FOREIGN PATENT DOCUMENTS 04 53 978 10/1991 European Pat. Off. ..... H01J 29/48
3-155026 7/1991 Japan ..... H01J 29/04
20 465 11 11/1980 United Kingdom ..... H01J 29/48

*Primary Examiner*—Frank G. Font
*Assistant Examiner*—Michael Day
*Attorney, Agent, or Firm*—Merchant, Gould, Smith, Edell, Welter & Schmidt, P.A.

[57] ABSTRACT

An electron gun is provided, in which a capacitance between a cathode and other electrodes, especially a control electrode is reduced largely without substantially changing a structure for supporting the cathode with an insulator. The cathode of this electron gun is disposed inside of the cylindrical metal shell. The cathode and the cylindrical metal shell are connected by three metal tabs. The cylindrical metal shell fits into a hole formed in the center portion of the insulator, and a metal outer frame is attached to the periphery of the insulator. The metal outer frame is welded to the inner surface of a cathode metal support. There is a control electrode facing the electron emitting surface of the cathode at a predetermined distance. Plural electrodes including an accelerating electrode are disposed in turn beyond the control electrode. Peripheries of the cathode metal support, control electrode, an accelerating electrode and other electrodes are embedded into sides of a pair of supporting rods that extend axially, so that the electrodes are fixed with a predetermined space between the electrodes.

9 Claims, 7 Drawing Sheets

Clear image

Unclear image

ELECTRON GUN WITH REDUCED CAPACITANCE BETWEEN ELECTRODES AND CATHODE-RAY TUBE USING THE GUN

BACKGROUND OF THE INVENTION

The present invention relates to an electron gun of a cathode-ray tube used for a television set or a computer display.

It is important to reduce an input capacitance between a cathode and other electrodes, especially a control electrode for adapting the cathode-ray tube to high frequency scanning for a high definition image.

FIGS. 6A and 6B show an example of a structure of the cathode and the control electrode in a conventional electron gun. FIG. 6A is a partial section along a plane perpendicular to the axis of the gun, and FIG. 6B is a partial section along a plane including the axis of the gun. The cathode includes a cylindrical sleeve 1, a cap 2 that closes one end of the sleeve, and an electron emitting substance 3 applied on the outer surface of the cap. The cathode 11 is surrounded by a cylindrical metal shell 5, which is disposed coaxially with the cathode 11. The cylindrical metal shell 5 and the cathode 11 are connected by three metal tabs 4 disposed at an angular spacing of 120 degrees.

The cylindrical metal shell 5 is engaged and fixed in an opening formed in the center portion of an insulator 7. The insulator 7 has an outer metal frame 6, which is attached to the periphery of the insulator 7 and is welded to an inner surface of a cap-shaped control electrode 14. Two brackets 18 are welded to an outer surface of the control electrode 14 at an angular spacing of 180 degrees. Each bracket 18 is embedded in a side of one of the support rods (so-called multiform rods) 13, so that the control electrode 14 is fixed.

The cathode 11 is heated by a heater (not shown in Figures) disposed inside of the cathode 11. The cathode 11 is supported by the insulator 7 indirectly via the cylindrical metal shell 5 and plural tabs 4, as mentioned above, in order to prevent heat of the cathode 11 from escaping via the supporting members for the cathode 11. However, this cylindrical metal shell 5 has an outer surface that faces the inner surface of the control electrode 14 via the insulator 7. Therefore, a substantially large capacitance is formed between the cathode 11 and the control electrode 14.

An improved structure for supporting the cathode is described in Japanese laid-open patent application (Tokkaihei) 3-155026, where the capacitance between the cathode and the control electrode is reduced compared with the above mentioned structure. This supporting structure, which is shown in FIGS. 7A and 7B, uses three metal pins 9 arranged in a circle instead of the cylindrical metal shell 5 used in FIGS. 6A and 6B, and three metal tabs 4. Each tab 4 is welded to the metal pin 9 and the cathode 11 to connect them. Thus, the cathode 11 is supported by the insulator 7' via the tabs 4 and the pins 9. This insulator 7' is different in shape from the insulator 7 in FIGS. 7A and 7B. The insulator 7' has an opening in the center portion and three small holes for fixing the pins 9 around the opening. The diameter of the center opening is a little larger than the outer diameter of the cathode 11. In this supporting structure, the capacitance between the cathode 11 and the control electrode 14 is reduced since the pins 9 have little surface facing the control electrode 14.

However, this supporting structure requires changing the shape of the insulator 7 and more time for manufacturing, so that the cost rises. In addition, the degree of parallelization and the distance between the surface of the electron emitting substance and the control electrode 14 must be controlled precisely. Therefore, the pins 9 have to be fixed to the insulator 7 at the same height and without slant before welding the tabs 4 to the pins 9 precisely. Thus, it is difficult to improve productivity.

The reduction rate of the capacitance by using the plural pins 9 instead of the cylindrical metal shell 5 is about 20–30%, from 5.0 pF to 3.5–4.0 pF, for example. This reduction rate is not enough for high frequency scanning above 100 kHz so as to obtain a high resolution image.

The present invention seeks a large reduction of the capacitance between the cathode and the control electrode without substantial change in the supporting structure for the cathode. It is another purpose of the present invention to reduce capacitance between the cathode and other electrodes such as an accelerating electrode or a focusing electrode, too.

SUMMARY OF THE INVENTION

An electron gun according to the present invention comprises a cathode having a surface that emits electrons; a control electrode facing the emitting surface of the cathode at a predetermined distance,; and support members for the cathode and the control electrode, the support members including a plurality of insulators and at least one conductor disposed therebetween so as to form serial capacitors between the cathode and the control electrode.

In the electron gun having the above configuration, the capacitance between the cathode and the control electrode, which is formed by supporting members for the cathode and the control electrode, is a combined capacitance of serial capacitors formed by a plurality of insulators and at least one conductor disposed therebetween, which make up the supporting members. Therefore, the capacitance between the cathode and the control electrode is reduced largely.

A concrete structure of the electron gun according to the present invention comprises a cathode; a cylindrical metal shell that has a larger diameter than the cathode, disposed surrounding the cathode, and connected to the cathode; an insulator that has an opening for receiving and fixing the cylindrical metal shell; a cathode metal support attached to the insulator; a control electrode facing an emitting surface of the cathode at a predetermined distance; other electrodes disposed with predetermined distances therebetween beyond the control electrode; and a plurality of insulating support bars extending along the axis of the gun for supporting the cathode metal support, the control electrode and the other electrodes with predetermined distances therebetween.

A further concrete structure of the electron gun according to the present invention comprises a cylindrical cathode with a closed end face; a cylindrical metal shell having a larger diameter than the cathode and disposed surrounding the cathode; a plurality of tab members for connecting the cathode and the cylindrical metal shell; an insulator having an opening for receiving and fixing the cylindrical metal shell; a cathode metal support attached to a peripheral portion of the insulator; a control electrode facing the end face of the cathode at a predetermined distance; other electrodes disposed with predetermined distances therebetween beyond the control electrode; and a plurality of insulating support bars extending along the axis of the gun for supporting peripheral portions of the cathode metal support, the control electrode and the other electrodes with predetermined distances therebetween.

According to the concrete structure of the electron gun described above, the capacitance between the cathode and the control electrode is reduced largely while supporting the cathode in a conventional and easy method using the cylindrical metal shell.

It is preferable that the conductor, i.e., the cathode metal support between the insulators, which makes up the supporting members of the cathode and the control electrode, is connected to ground via an impedance element such as a resistor, a capacitor or an inductor. If the conductor (cathode metal support) is floating, it may receive an induced potential and make the potential of the cathode unstable. However, the connection of the conductor to ground via the impedance element can suppress such a possibility.

It is also preferable that the control electrode includes a center body, an insulator attached to a peripheral portion of the center body, and a metal support attached to a peripheral portion of the insulator. According to this structure, a third capacitor is formed between the center body and the metal support. Thus, three serial capacitors are formed between the center body of the control electrode and the cathode, so that the capacitance between electrodes is further reduced.

The above mentioned structure can be applied not only to the control electrode but also to other electrodes such as an accelerating electrode or a focusing electrode. Therefore, it is preferable that at least one of the other electrodes includes a center body, an insulator attached to a peripheral portion of the center body, and a metal support attached to a peripheral portion of the insulator.

The cylindrical cathode preferably includes a cylindrical sleeve, a cap closing an end portion of the sleeve, and an electron emitting substance applied on the outer surface of the cap.

The cathode-ray tube according to the present invention comprises the electron gun having the structure mentioned above; a neck portion housing the electron gun; a funnel portion extending from the neck portion; and a panel portion connected to the funnel portion so as to close the opening of the funnel portion, the panel portion having a phosphor screen on the inner surface.

DETAILED DESCRIPTION OF THE PREFERRED EMBODIMENTS

Figure 2:
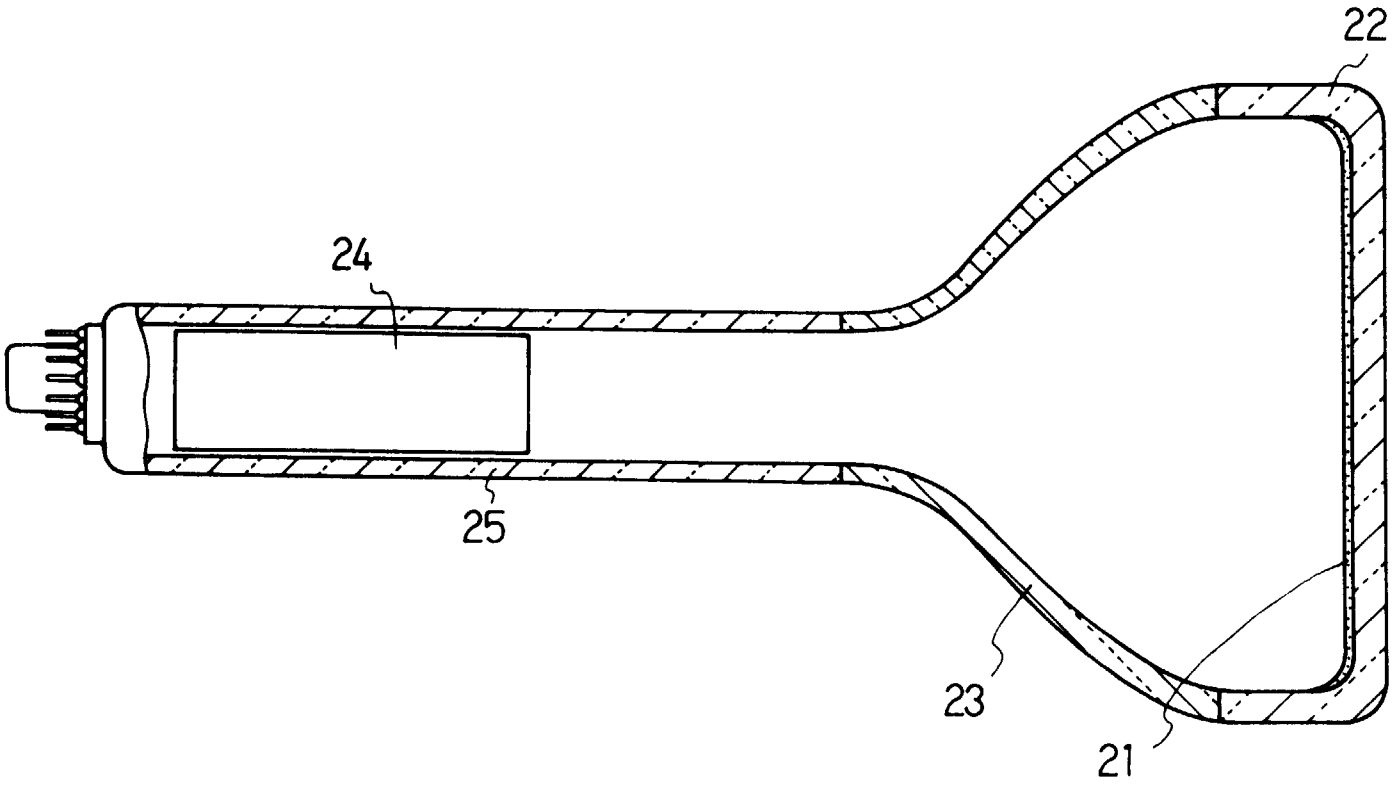
FIG. 2 is a cross section of a cathode-ray tube according to the present invention.

An overall structure of a cathode-ray tube according to the present invention is illustrated in a cross section in FIG. 2. This example is a single beam electron gun, which is used for a projection television set. This cathode-ray tube comprises a neck portion 25 housing the electron gun, a funnel portion extending from the neck portion, and a panel portion 22 connected to the funnel portion so as to close the opening of the funnel portion. The panel portion 22 has a phosphor screen 21 on the inner surface.

Figure 1A:
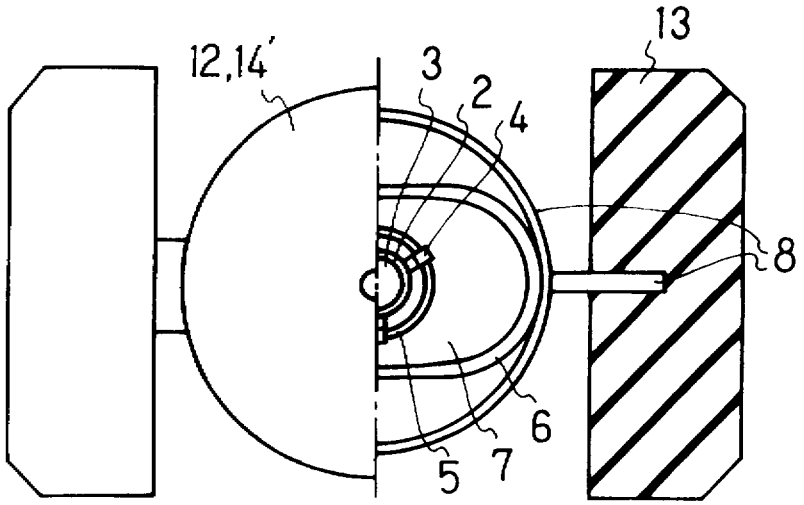
FIG. 1A is a partial cross section of a cathode and control electrode portion along a plane perpendicular to the axis of an electron gun of a first embodiment according to the present invention.
Figure 1B:
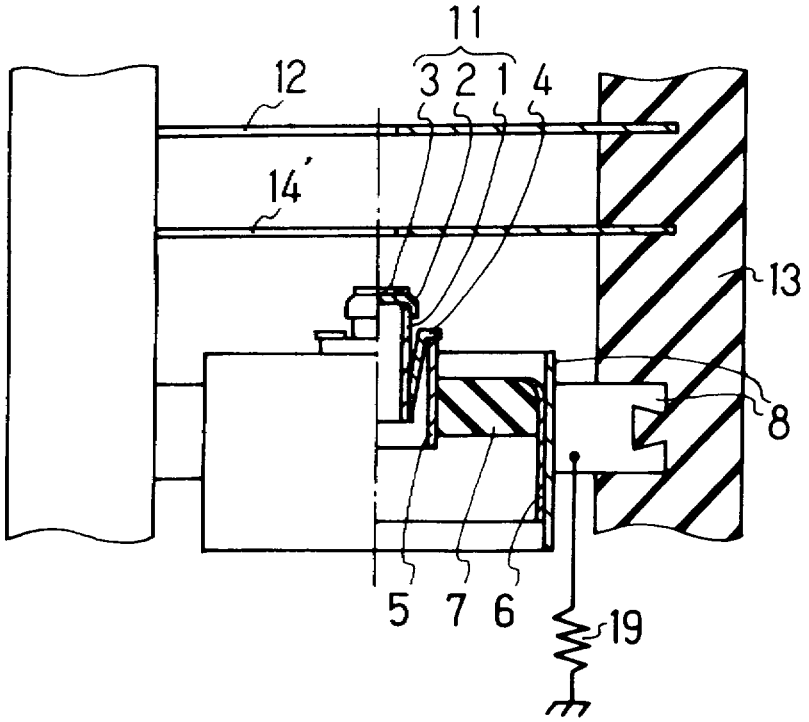
FIG. 1B is a partial cross section of a cathode and control electrode portion along a plane including the axis of the electron gun shown in FIG. 1A.

FIGS. 1A and 1B illustrate a part of the electron gun 24, including a cathode 11 and a control electrode 14'. FIG. 1A is a partial cross section along a plane perpendicular to the axis of the electron gun. FIG. 1B is a partial cross section along a plane including the axis of the electron gun. In FIGS. 1A and 1B, the identical elements as in FIGS. 6A and 6B referred to in the explanation of the prior art, are indicated with the same numerals.

The cathode 11 includes a sleeve 1 that is made of Ni—Cr material and is oxidation-treated on the inner and outer surfaces, a cap 2 that is made of Ni material and closes an end of the sleeve 1, and an electron emitting substance 3 that is made mainly of an alkaline earth metal and is applied on the outer surface of the cap 2. A cylindrical metal shell 5 made of Fe—Ni—Co material is disposed surrounding the cathode 11. Three metal tabs 4 made of Fe—Ni material are disposed at an angular spacing of 120 degrees between the cathode 11 and the cylindrical metal shell 5 so as to connect them by welding.

The cylindrical metal shell 5 fits in a hole formed in a center portion of an insulator 7 made of glass material whose major component is $ZnO/B_2O_3$ and fixed to the insulator 7. A metal frame 6, made of Fe—Ni material for example, is attached to the periphery of the insulator 7. The metal frame is fixed to an inner surface of a cylindrical portion of a cathode metal support 8 that is made of Fe—Ni material. The cathode metal support 8 has protrusions, which protrude outward and are embedded in side walls of a pair of support rods (multiform rods) 13 whose major component is $SiO_2$.

The cathode sleeve 1 is connected to the cylindrical metal shell 5 via tabs 4 as mentioned above. If the cathode sleeve 1 is welded directly to the cylindrical metal shell 5, the necessary power for heating the emitting substances applied on the cathode cap 2 to emit enough electrons may be too big, since the heat of the cathode cap 2 may easily escape through the cylindrical metal shell 5. The cylindrical metal shell 5 is provided with a metal ribbon (not shown in the Figure) for supplying a cathode signal to the cathode 11.

Figure 6A:
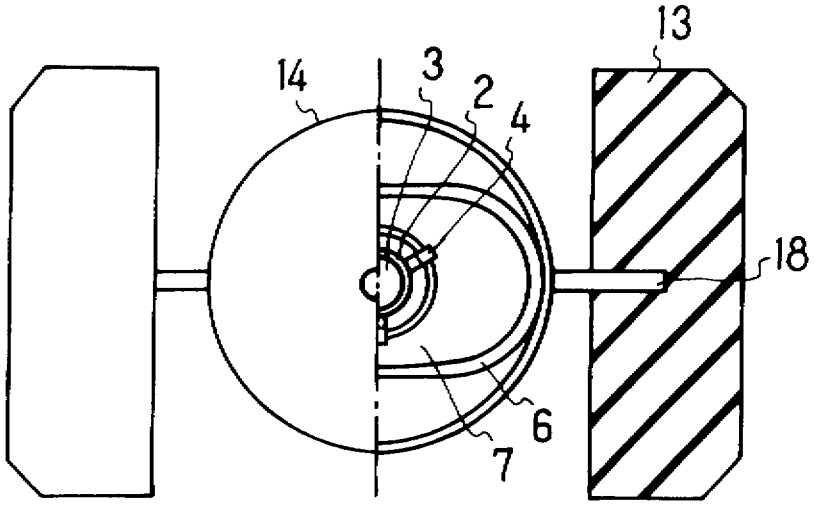
FIG. 6A (PRIOR ART)
FIG. 6A is a partial cross section of a cathode and control electrode portion along a plane perpendicular to the axis of an electron gun in the prior art.
Figure 6B:
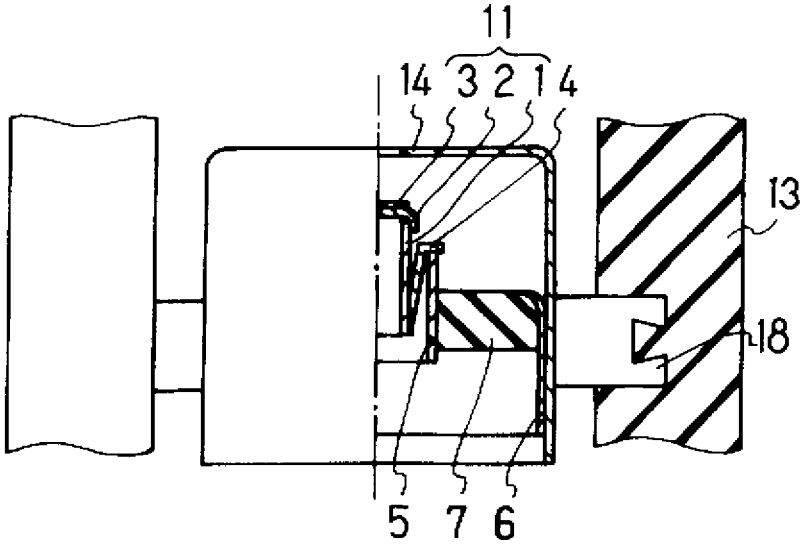
FIG. 6B (PRIOR ART)
FIG. 6B is a partial cross section of a cathode and control electrode portion along a plane including the axis of the electron gun shown in FIG. 6A.

The electron gun of this embodiment shown in FIGS. 1A and 1B has a different support structure for the cathode and the control electrode from that of the prior art shown in FIGS. 6A and 6B. The support structure in the present invention is a so-called bead support structure, where the insulator 7 for supporting the cathode 11 and the outer metal frame 6 of the insulator 7 are apart from the control electrode 14'. The control electrode 14', which is made of Fe—Ni material, has a plate shape. Peripheral protrusions of the control electrode 14' are embedded in the side wall of the pair of support rods 13, so that a space of 100 micron is maintained between the inner surface of the control electrode 14' and the outer surface of the emitting substance 3. The control electrode, however, is not limited to the plate shape. It may have a cup shape with a bowed periphery.

There is an accelerating electrode 12 beyond the control electrode 14' (at the side opposite to the cathode 11) and other electrodes such as a focusing electrode and an anode (not shown in the Figure) are disposed in that order beyond the accelerating electrode. These electrodes are fixed by embedding peripheral protrusions of the electrodes in the pair of supporting rods.

In the electron gun of this embodiment, first and second capacitors connected serially are formed by supporting members 5–8 and 13 of the cathode 11 and the control electrode 14'. The first capacitor is formed by the cylindrical metal shell 5 connected to the cathode 11 and the outer metal frame 6 as facing electrodes, and the insulator 7 therebetween as a dielectric. The second capacitor is formed by the cathode metal support 8 connected to the outer metal frame 6 and the control electrode as facing electrodes, and the support rod 13 therebetween as a dielectric.

The combined capacitance of the first and second capacitors connected serially is an inverse of a sum of the inverses of the first and second capacitors. Thus, the capacitance between the cathode and the control electrode is reduced largely compared with that in the prior art.

An example of the cathode-ray tube manufactured in accordance with this embodiment and measured result of the capacitance is explained below. The manufactured tube is a cathode-ray tube for a projection television having a 7-inch screen, and its electron gun is a so-called bipotential gun, which has one control electrode, one accelerating electrode, one focusing electrode and one anode. The principal dimensions of the gun are as followings: the metal frame 6 has an oval shape with a long diameter of 9 mm and a short diameter of 5 mm, and a height of 4 mm; the insulator 7 has a thickness of 1.5 mm; the cylindrical metal shell 5 has an outer diameter of 4 mm and a height of 3 mm; the cylindrical portion of the cathode metal support 8 has an inner diameter of 9 mm and a height of 5.5 mm; the distance between the surface of the emitting substance 3 and the control electrode 14 is 0.1 mm; the thickness of the control electrode is 0.2 mm; and the distance between the control electrode and the accelerating electrode is 0.4 mm.

The capacitance between the cathode and the other electrodes was measured by connecting a stem pin of the cathode to one of the measuring terminals of a capacitance measuring device, and by connecting other stem pins of the other electrodes together to another terminal of the measuring device. The measuring frequency was set at 100 kHz. The result of the capacitance between the cathode and other electrodes was 2.0 pF.

Figure 7A:
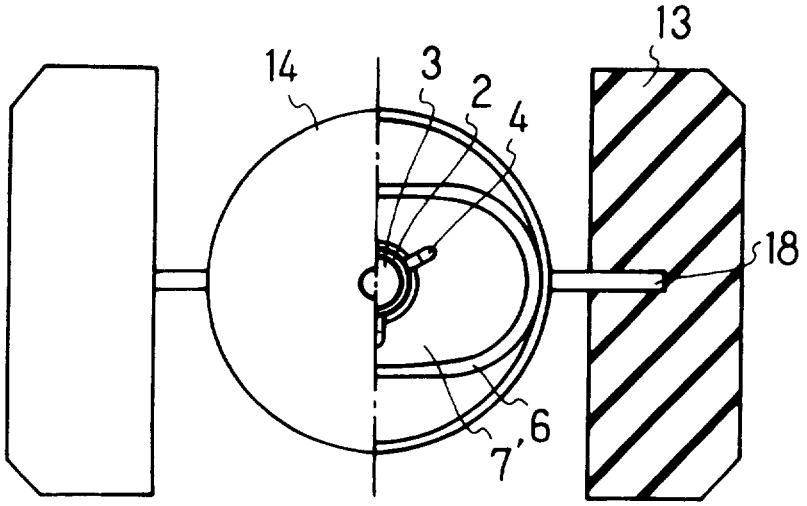
FIG. 7A (PRIOR ART)
FIG. 7A is a partial cross section of a cathode and control electrode portion along a plane perpendicular to the axis of another electron gun in the prior art.
Figure 7B:
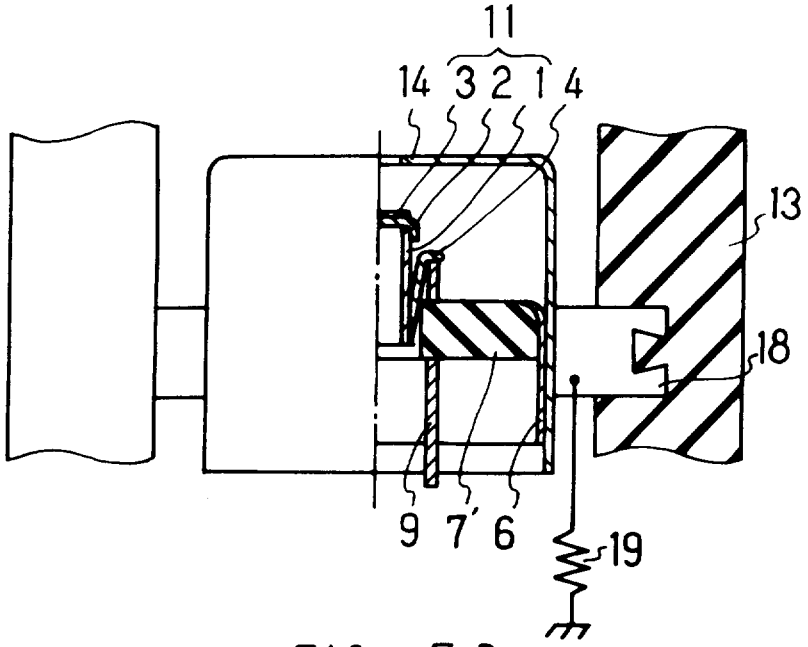
FIG. 7B (PRIOR ART)
FIG. 7B is a partial cross section of a cathode and control electrode portion along a plane including the axis of the electron gun shown in FIG. 7A.

The capacitance between electrodes of the cathode-ray tube shown in FIGS. 7A and 7B was also measured for comparison. In this cathode-ray tube of the prior art, the outer diameter of the pin 9 is 0.4 mm, the cap-shaped control electrode 14 has an inner diameter of 9 mm and a height of 5.5 mm. Other dimensions are the same as the above example according to the present invention. The result of the capacitance between the cathode and the other electrodes of the prior art was 3.9 pF.

As explained above, the capacitance between the cathode and other electrodes is reduced about 50% by adapting the structure shown in FIGS. 1A and 1B according to the present invention, compared with that of the prior art shown in FIGS. 7A and 7B.

The capacitance between the cathode and the control electrode was also measured since this capacitance is considered to have the largest influence when scanning in high frequency in a cathode-ray tube. In this measurement, the stem pin of the cathode was connected to one of the terminal of the measuring device, the stem pin of the control electrode was connected to another measuring terminal of the device, and other stem pins were connected to the ground. Other measuring conditions were same as the foregoing conditions. The result of the capacitance between the cathode and the control electrode was 0.3 pF. The cathode ray-tube of the prior art shown in FIGS. 7A and 7B was also measured, and the result of the capacitance between the cathode and the control electrode was 1.8 pF. It is apparent that the reduction of the capacitance between electrodes in the electron gun structure according to the present invention is obtained mainly in the capacitance between the cathode and the control electrode.

The reduction of the capacitance between electrodes according to the present invention improves the quality of a displayed image in the cathode-ray tube as explained below.

Figure 3:
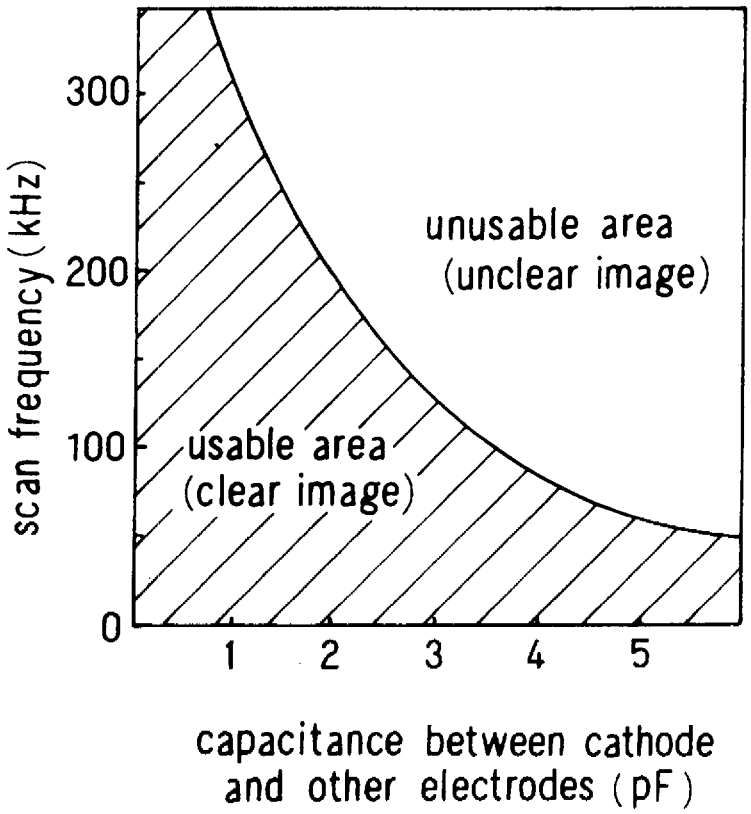
FIG. 3 is a graph showing the area where a clear image can be obtained in relation to a scanning frequency and a capacitance between a cathode and a control electrode of the electron gun.

FIG. 3 shows a range in an X-Y coordinate system where a clear image is obtained, wherein the X-axis indicates a capacitance between the cathode and the other electrodes, and the Y-axis indicates a scanning frequency. It is apparent from FIG. 3 that a substantially clear image can be obtained at the scanning frequency up to 200 kHz when the capacitance between the cathode and other electrodes is 2.0 pF that was obtained in the above example of the present invention. On the other hand, it is difficult to obtain a clear image at the scanning frequency above 100 kHz when the capacitance between the cathode and other electrodes is 3.9 pF that was obtained in the prior art shown in FIGS. 7A and 7B.

Figures 4A, 4B:
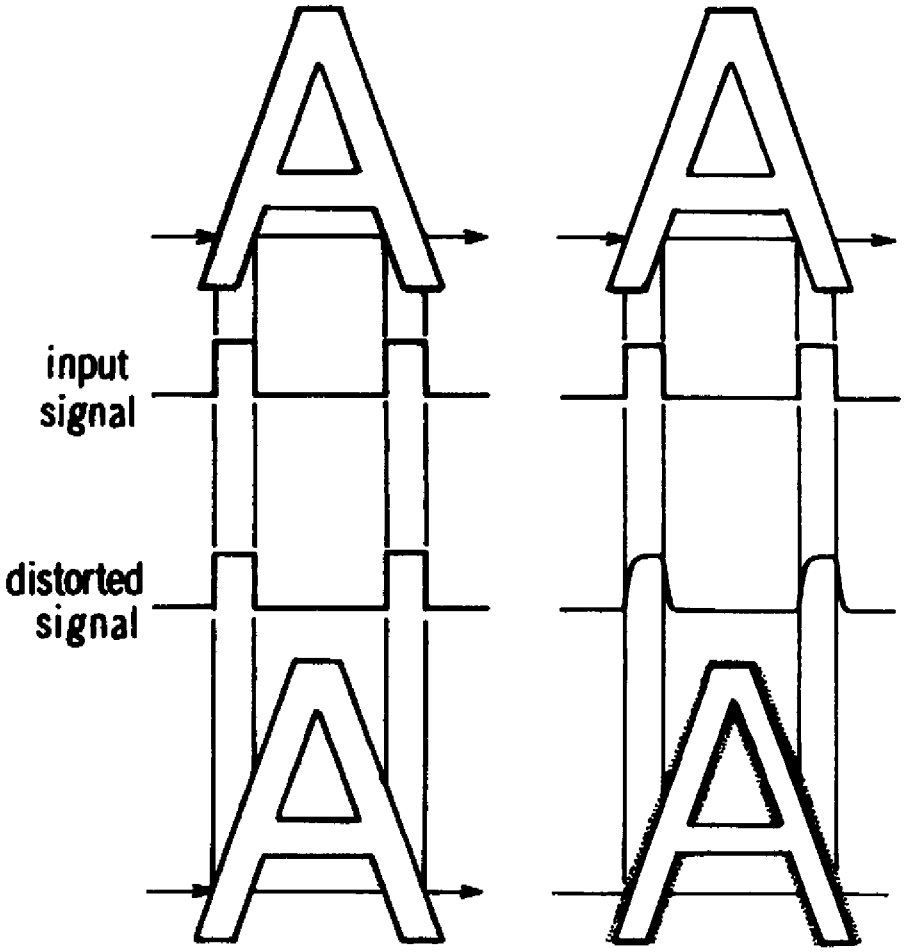
FIG. 4 illustrates an example comparing a clear image and an unclear image.

FIG. 4 shows a comparison of a clear image and an unclear image. In (a) Clear image, an outline of the displayed character "A" is sharp. On the other hand, in (b) Unclear image, the outline of the displayed character "A" is not sharp since the rising and falling edges of an input signal are distorted due to the capacitance between electrodes. As shown in FIG. 4, the input signal is not distorted in (a) Clear image, but it is distorted a little in (b) Unclear image. This wave distortion becomes larger along with increasing of the capacitance between electrodes or increasing of the frequency of the input signal. The frequency of the input signal increases along with increasing of the scanning frequency. Therefore, the range where a clear image can be obtained is limited depending on the relationship between the scanning frequency and the capacitance between electrodes as shown in FIG. 3.

It was found that a cathode potential and a current drawn from the cathode might be unstable if the scanning frequency exceeds 100 kHz, since the cathode metal support 8 picks up an induced potential in the cathode-ray tube having the structure mentioned above according to the present invention. To eliminate this possibility, it is preferable to connect the cathode metal support 8 to the ground level via an impedance element 19.

In an example, the impedance element 19 is a carbon-film resistor having a resistance above 1.0 megohm, though it may be other elements such as a capacitor or an inductor having the same impedance against high frequency (preferably more than 100 times of the image output impedance). This impedance element can be disposed inside the cathode-ray tube, or outside the tube by connecting the cathode metal support 8 to an unused stem pin.

In an example, the cathode metal support 8 is connected to ground via a 10 megohm resistor. The capacitance between the cathode and the other electrodes was 2.8 pF, and the capacitance between the cathode and the control electrode is 0.8 pF in this example. Though the capacitance between electrodes increases a little by connecting the cathode metal support to ground via the impedance element, the possibility of the current from the cathode being unstable is eliminated. Therefore, an adequate impedance value of the impedance element may be selected considering the scanning frequency.

Figure 5A:
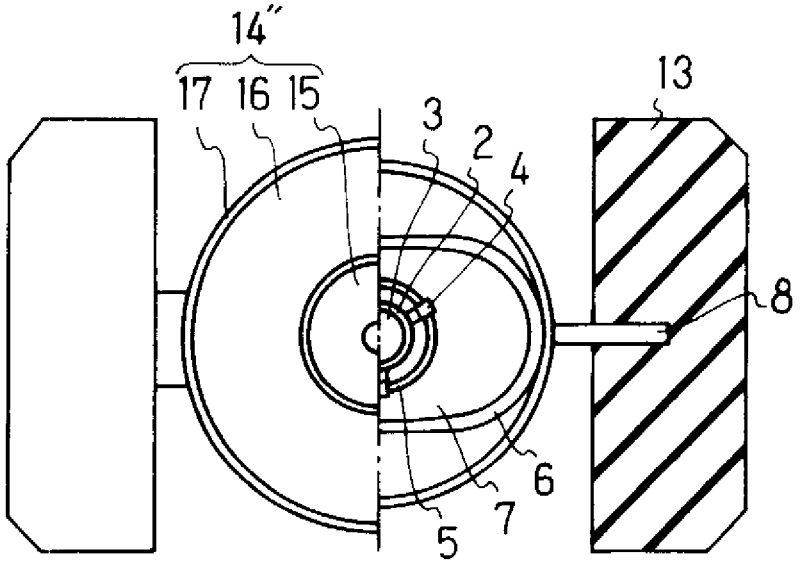
FIG. 5A is a partial cross section of a cathode and control electrode portion along a plane perpendicular to the axis of an electron gun of a second embodiment according to the present invention.
Figure 5B:
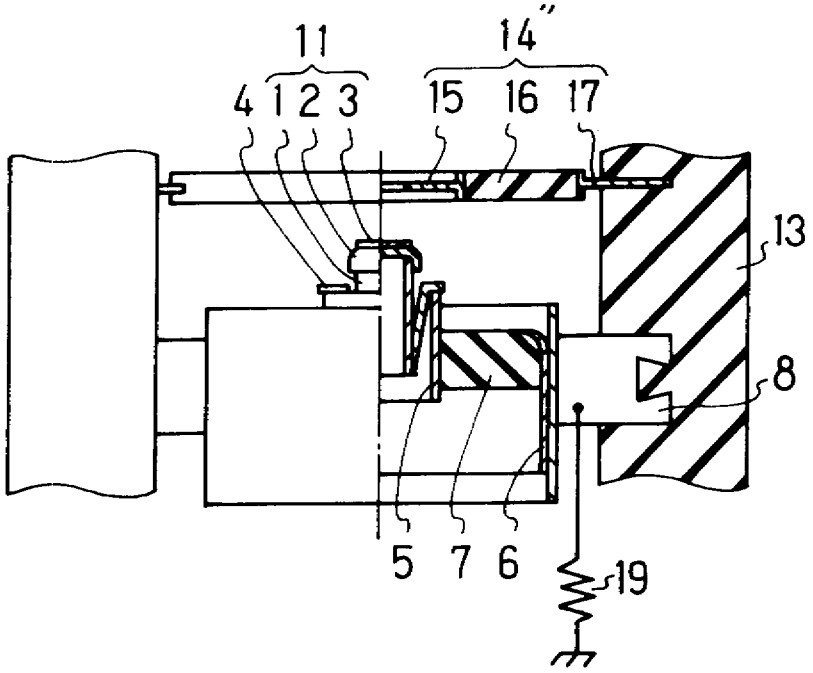
FIG. 5B is a partial cross section of a cathode and control electrode portion along a plane including the axis of the electron gun shown in FIG. 5A.

The second embodiment of the present invention is illustrated in FIGS. 5A and 5B. FIG. 5A is a partial cross section along a plane perpendicular to the axis of the electron gun. FIG. 5B is a partial cross section along a plane including the axis of the electron gun. In this embodiment, an improvement for further reducing the capacitance between electrodes is added to the structure mentioned above as the first embodiment. The control electrode 14' includes a center body 15 made of Fe—Ni material, a ring-shaped insulator 16 made of ceramic and attached to the periphery of the center body 15 and a metal support 17 made of Fe—Ni material and attached to the periphery of the insulator 16. According to this structure, a third capacitor is formed by the center body 15 and metal support 17 as facing electrodes, and the ring-shaped insulator 16 as a dielectric.

As a result, three serial capacitors are formed between the cathode 11 and the center body 15 of the control electrode, so that the capacitance between electrodes is further reduced. In an example of a cathode-ray tube manufactured according to this embodiment, a measured value of the capacitance between the cathode and the other electrodes was 1.5 pF under foregoing condition.

The above mentioned structure can also be applied to other electrodes such as an accelerating electrode or a focusing electrode, so that the capacitance between the cathode and the other electrodes can be further reduced.

The cathode metal support 8 is preferably connected to ground via an impedance element 19 in this embodiment, too. Thus, the possibility of the current drawn from the cathode being unstable is eliminated.

Though the present invention is described in detail using the embodiment mentioned above, the present invention can be applied to any type of cathode-ray tube having a Wehnelt cathode, an impregnated cathode, a directly heated cathode, a cold cathode or other type of cathode. The present invention can be applied to not only a single beam type tube but also a multibeam type such as a color picture tube.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, an all change which come within the meaning and range of equivalency of the claims are intended to be embraced therein.

We claim:

1. An electron gun for a cathode-ray tube, comprising a cathode having a surface that emits electrons; a control electrode facing the emitting surface of said cathode at a predetermined distance; and support members for said cathode and said control electrode, the members including a plurality of insulators and at least one conductor disposed therebetween so as to form serial capacitors between said cathode and said control electrode, wherein said conductor is connected to ground with an impedance element.

2. An electron gun for a cathode ray tube according to claim 1, wherein said control electrode includes a center body, an insulator attached to a peripheral portion of said center body, and a metal support attached to said insulator.

3. An electron gun for a cathode-ray tube, comprising:

a cathode having a surface that emits electrons;

a cylindrical metal shell having a larger diameter than said cathode, said metal shell disposed surrounding said cathode, and connected to said cathode;

an insulator having an opening for receiving and fixing said cylindrical metal shell;

a cathode metal support attached to said insulator;

a control electrode facing the emitting surface of said cathode at a predetermined distance and other electrodes; and a plurality of insulating support bars extending along the axis of the gun for supporting said cathode metal support, said control electrode and said other electrodes, wherein said cathode metal support is connected to ground with an impedance element.

4. The electron gun according to claim 3, wherein at least one of said other electrodes includes a center body, an insulator attached to a peripheral portion of said center body, and a metal support attached to a peripheral portion of said insulator.

5. A cathode-ray tube comprising an electron gun according to claim 3, a neck portion housing said electron gun; a funnel portion extending from said neck portion; and a panel portion connected to said funnel portion so as to close the opening of said funnel portion, said panel portion having a phosphor screen on its inner surface.

6. An electron gun for a cathode-ray tube, comprising:

a cylindrical cathode with a closed end face;

a cylindrical metal shell having a larger diameter than said cathode, said metal shell disposed surrounding said cathode;

a plurality of tab members for connecting said cathode and said cylindrical metal shell;

an insulator having an opening for receiving and fixing said cylindrical metal shell;

a cathode metal support attached to a peripheral portion of said insulator;

a control electrode facing said end face of said cathode at a predetermined distance and other electrodes; and a plurality of insulating support bars extending along the axis of the gun for supporting peripheral portions of said cathode metal support, said control electrode and said other electrodes, wherein said cathode metal support is connected to ground level with an impedance element.

7. The electron gun according to claim 6, wherein said control electrode includes a center body, an insulator attached to a peripheral portion of said center body, and a metal support attached to a peripheral portion of said insulator.

8. The electron gun according to claim 6, wherein at least one of said other electrodes includes a center body, an insulator attached to a peripheral portion of said center body, and a metal support attached to a peripheral portion of said insulator.

9. The electron gun according to claim 6, wherein said cathode includes a cylindrical sleeve, a cap closing an end portion of said sleeve, and an electron emitting substance applied on the outer surface of said cap.

* * * * *